US005161639A

United States Patent [19]

Ice

[11] Patent Number: 5,161,639

[45] Date of Patent: Nov. 10, 1992

[54] DERRICK COUNTERWEIGHT ASSEMBLY

[75] Inventor: James H. Ice, Abilene, Tex.

[73] Assignee: J-D Equipment Incorporated, Abilene, Tex.

[21] Appl. No.: 811,696

[22] Filed: Dec. 20, 1991

[51] Int. Cl.[5] ..... A62B 35/00; E06C 5/36

[52] U.S. Cl. ..... 182/8

[58] Field of Search ..... 182/3, 4, 5, 6, 7, 8, 182/9, 207

[56] References Cited

U.S. PATENT DOCUMENTS 1,140,708 5/1915 Pauly .
1,641,798 9/1927 Bocchino .
1,808,492 6/1931 Bocchino .
2,538,904 1/1951 Herod ..... 182/8
4,252,214 2/1991 Miller ..... 182/8
4,458,781 7/1984 Ellis et al. .
4,538,703 9/1985 Ellis et al. .
4,550,804 11/1985 Bummer .
4,997,064 3/1991 Motte ..... 182/8

*Primary Examiner*—Reinaldo P. Machado
*Attorney, Agent, or Firm*—James E. Bradley

[57] ABSTRACT

A telescoping derrick has a safety line which is attached to a harness which secures to a worker to be used while climbing the ladder of the derrick. Telescoping tube sections are mounted to the derrick for extension and contraction with the derrick sections. The line is trained over a pulley attached to the crown of a derrick, then passes into the telescoping tube. The line is connected to a counterweight located in the telescoping tube. The line and counterweight remain inside the telescoping tube during rig up and rig down of the derrick.

8 Claims, 1 Drawing Sheet

DERRICK COUNTERWEIGHT ASSEMBLY

BACKGROUND OF THE INVENTION

1. Field of the Invention

This invention relates in general to a telescoping derrick, and in particular, to a safety device attached to a derrick which assists a climber in his assent and descent of the derrick.

2. Description of the Prior Art

Many assent and descent assistance devices use a counterweight to control the rate at which a climber ascends or descends. Workover rigs for oil and gas wells present special problems in protecting against injury resulting from falls due to the distance climbed. The worker may be required to climb while carrying tools and in harsh weather.

Typically, the climbing assistance apparatus which is presently used includes a counterweight to assist personnel in climbing and to control their descent. Normally the counterweight is carried on a line extending outward from the derrick to a stake driven in the ground. The line is reeved over a pulley. A harness locates at the other end for use by the climber. A disadvantage is that the lines and counterweight must be disassembled before the rig is contracted and reassembled after the rig is extended. This procedure is time consuming.

SUMMARY OF THE INVENTION

In this invention, upper and lower sections of a telescoping tube are mounted to the upper and lower sections of the telescoping derrick for movement therewith. The safety line has a counterweight assembly carried in the telescoping tube. A harness for a worker attaches to the other end of the line. The line is trained over a pulley arrangement attached to the crown of the derrick.

The telescoping tube extends and contracts with the extension and contraction of the derrick. The tube allows the line and counterweight to remain in place in the tube when the derrick is collapsed and transported.

DETAILED DESCRIPTION OF THE INVENTION

Figure 1:
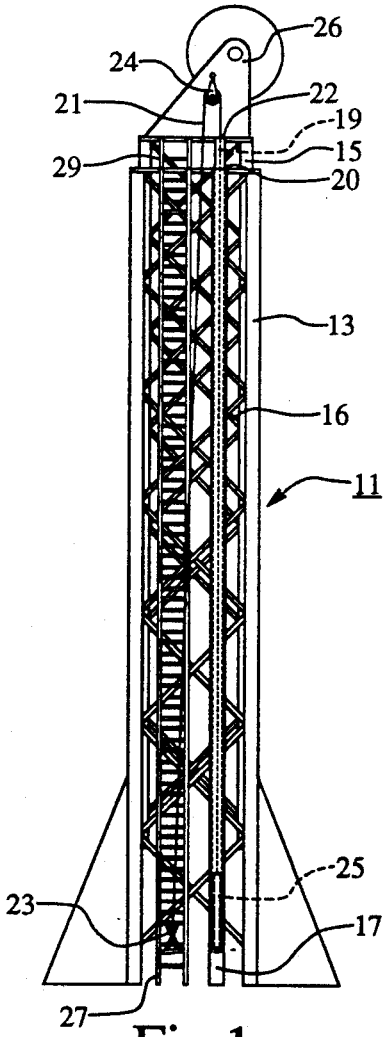
FIG. 1 is a schematic front view illustrating the telescoping derrick and safety device in the collapsed position.
Figure 2:
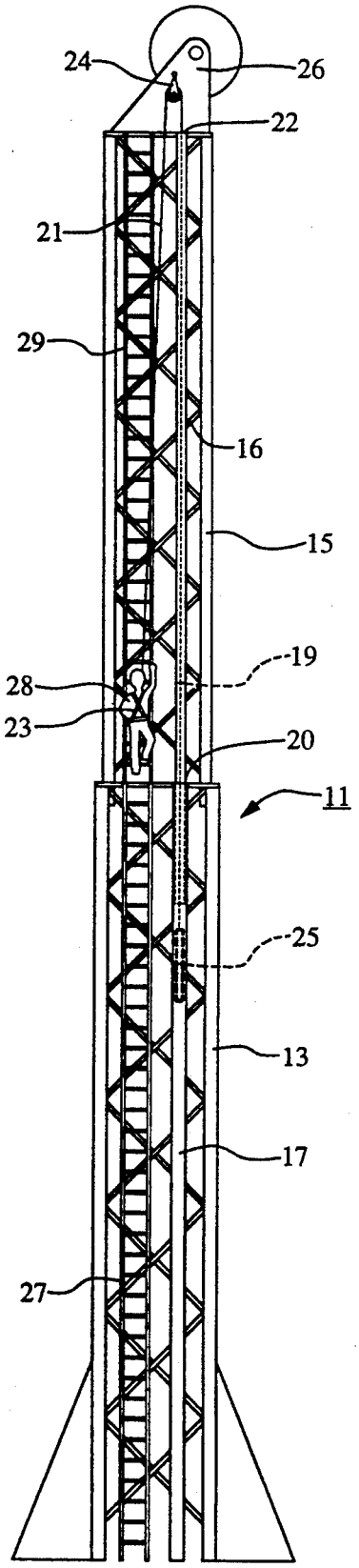
FIG. 2 is another schematic front view of the telescoping derrick and safety device of FIG. 1, but showing the derrick in the extended position.

Referring to the Figures, a conventional telescoping derrick 11 is shown. Derrick 11 is particularly used for performing workover operations on oil and gas wells. Derrick 11 has a lower section 13 which receives an upper section 15 as the telescoping derrick is contracted. Upper section 15 is approximately the same length as lower section 13. This results in a height of the derrick 11 when contracted as shown in FIG. 1 being approximately one-half the height of the derrick 11 in its extended position shown in FIG. 2. Derrick 11 utilizes conventional braces 16 to stabilize the telescoping derrick 11 in its upright position. Referring to FIG. 2, upper derrick section 15 extends upward relative to lower derrick section 13 as derrick 11 is raised to its extended position. Conventional equipment will extend and retract derrick 11.

A lower telescoping tube 17 is attached to lower section 13 by a number of brackets 20. An upper telescoping tube 19 is attached to the upper end of upper section 15 by a bracket 22. Telescoping tube sections 17, 19 are preferably square. Also, preferably the cross-sectional area of the upper section 19 is less than the cross-sectional area of the lower section 17. The lower end of the upper telescoping tube 19 extends slidingly into the upper end of the lower telescoping tube 17. The length of the upper telescoping tube 19 is approximately the same length as the derrick upper section 15. The length of the lower telescoping tube 17 is approximately the same as the length of the lower derrick section 13.

A safety line 21 is installed on derrick 11. The length of line 21 is approximately equal to twice the height of the derrick 11 in the collapsed position, or approximately the same length as the height of derrick 11 when in the extended position. Line 21 extends from a harness 23 upward over pulley 24 and downward through upper tube 19 and lower tube 17 to a counterweight 25 on the opposite end of line 21 from harness 23. Pulley 24 is mounted to the upper end or crown 26 of the derrick upper section 15. Harness 23 is a conventional strap or securing device for engagement by a person 28 climbing the derrick 11.

Line 21 moves upward over pulley 24 as counterweight 25 moves downward relative to climber 28, assisting climber 28. Counterweight 25 is a weight that is a selected percent of the average weight of a climber 28, normally about 117 pounds. Counterweight 25 moves upward and downward through the lower and upper tube sections 17, 19. The lower end of the upper tube section 19 is flared to prevent the counterweight 25 from catching on the edge while it moves upward relative the tube sections 17, 19.

The climber 28 will climb a ladder, which has a lower section 27 and an upper section 29. The lower ladder section 27 is rigidly attached to lower derrick section 13, and the upper ladder section 29 is rigidly attached to upper section 15 of derrick 11.

In operation, the derrick 11 is moved on a truck to a new well location while tilted and collapsed. While being transported, the counterweight 25 and harness 23 will be located at the lower ends of the lower section 27 of the ladder and lower section of the tube 17, respectively. The line 21 will remain reeved over the pulley 24.

The operator will then tilt the derrick 11 upright and extend the upper derrick section 15. While extending, the operator will keep the harness 23 fastened to the lower end of the lower ladder section 27. The upper tube section 19 will move upward with the upper derrick section 15. The upward movement of the upper derrick section 15 causes the counterweight 25 to move upward in the tube sections 17, 19. When fully extended, the counterweight 25 will be near the crown 26 of the derrick 11, and the harness 23 will still be attached to the bottom of the lower section 27 of the ladder.

When the climber 28 begins assent of the ladder sections 27, 29 and moves upward toward the crown 26 of the derrick 11, the counterweight 25 moves downward relative to the climber 28, assisting the climber in the assent, and providing safety in the event of a fall. As the climber 28 moves upward toward the crown 26, the counterweight 25 moves downward through the sections 17, 19 of the tube toward the base of the derrick 11. When the climber 28 is at the top, the counterweight 25 will be at the bottom of the lower tube section 17. When the climber 28 is descending the ladder section 27, 29, the counterweight 25 moves upward through the tube sections 17, 19.

To move the derrick 11 to a new location, the operator lowers the upper derrick section 15. The harness 24 will remain secured to the lower end of lower ladder section 27. The counterweight 25 will move from the upper end of upper tube section 19 downward to the lower end of lower tube section 17. The operator tilts the derrick 11 once collapsed and transports the derrick 11 to a new location. The operator will tie a line from the counterweight 25 to the lower section of the derrick to prevent the counterweight 25 from sliding forward while transporting.

The invention has significant advantages. It provides for easier rigging up of the derrick and its associated lines. The tubes keep the line and counterweight from becoming entangled in other parts of the derrick. The counterweight and line do not have to be disconnected from the derrick when the derrick is moved, collapsed or extended but can remain attached and carried in the tube sections. Faster rig down, without the requirement of disconnecting the counterweight and lines, is also an advantage. The counterweight and lines remain tangle free and in position during transport, extension and contraction for safer rigging up and rigging down.

What is claimed is:

1. In a telescoping derrick of a type having upper and lower sections which are moveable between a contracted and an extended position, an upper and lower ladder affixed to the upper and lower telescoping sections, respectively, of the telescoping derrick, an improved safety device to assist a climber, comprising in combination:

a line;

a securing means affixed to a first end of the line for engagement by the climber;

a telescoping tube having upper and lower sections and attached to the upper and lower sections, respectively, of the telescoping derrick, so as to move between the contracted and the extended positions in unison with the telescoping derrick;

a counterweight affixed to a second end of the line and carried in the telescoping tube; and a pulley affixed to the upper section of the telescoping derrick over which the line is reeved.

2. The telescoping derrick according to claim 1, wherein the upper section of the telescoping tube slides into the lower section of the telescoping tube.

3. The telescoping derrick according to claim 1, wherein the line has a length that is substantially equal to the height of the telescoping derrick when in the extended position.

4. The telescoping derrick according to claim 1, wherein the upper section of the telescoping tube is approximately equal in length to the lower section of the telescoping tube, and the upper section of the telescoping derrick is approximately equal in length to the lower section of the telescoping derrick.

5. The telescoping derrick according to claim 1, wherein in the extended position, the line has a length selected such that the counterweight will be located at an upper end of the upper section of the telescoping tube when the securing means is located at a lower end of the lower section of the telescoping derrick, so that when the telescoping derrick is moved to the contracted position, while the securing means is retained at the lower end of the lower section of the telescoping derrick, the counterweight will move downward into the lower section of the telescoping tube.

6. In a telescoping derrick of a type having upper and lower sections movable between a contracted and an extended position, the lower section of the telescoping derrick and the upper section of the telescoping derrick being approximately equal in length, an upper and lower ladder affixed to the upper and lower sections, respectively, of the telescoping derrick, an improved safety device to assist a climber, comprising in combination:

a pulley mounted to the upper end of the derrick;

a line extending over the pulley;

a harness affixed to the first end of the line;

the line having a length approximately equal in length to the telescoping derrick in the extended position;

a telescoping tube having upper and lower sections and attached to the upper and lower sections respectively, of the telescoping derrick so as to move between the contracted and the extended positions in unison with the telescoping derrick;

a counterweight affixed to a second end of the line and carried in the telescoping tube; and wherein the counterweight is at the upper end of the upper section of the telescoping tube and the harness is at the lower end of the lower section of the telescoping derrick when the telescoping derrick is in the extended position, and wherein the counterweight moves downward to the lower end of the lower section of the telescoping tube when the upper section of the derrick moves to the contracted position.

7. The telescoping derrick according to claim 6, wherein the telescoping tube is square in shape and wherein the lower section of the telescoping tube has an interior cross sectional area greater than an exterior cross sectional area of the upper section of the telescoping tube.

8. A method of mounting a safety device for a climber to a telescoping derrick, the derrick being of the type having upper and lower sections and an upper and a lower ladder affixed to the upper and lower sections respectively, of the telescoping derrick, the method comprising: 13 attaching a lower section of a telescoping tube to the lower section of the telescoping derrick;

6 attaching an upper section of the telescoping tube to the lower section of the telescoping derrick and inserting a lower end of the upper section of the telescoping tube into an upper end of the lower section of the telescoping tube;

mounting a pulley to an upper end of the upper section of the telescoping tube;

securing a securing device to one end of a line for engagement by a user and attaching a counterweight to the other end of the line;

extending the line upward over the pulley and downward with the counterweight into the telescoping tube; and moving the telescoping derrick to an extended position while restraining the securing device at the lower end of the lower section of the telescoping derrick, causing the upper section of the telescoping tube to move upward relative to the lower telescoping tube and causing the counterweight to move upward in the telescoping tube.

* * * * *